US007412033B2

(12) United States Patent
Freudenberger et al.

(10) Patent No.: US 7,412,033 B2
(45) Date of Patent: Aug. 12, 2008

(54) X-RAY RADIATOR WITH THERMIONIC EMISSION OF ELECTRONS FROM A LASER-IRRADIATED CATHODE

(75) Inventors: Jörg Freudenberger, Eckental (DE); Sven Fritzler, Erlangen (DE); Manfred Fuchs, Nürnberg (DE); Detlef Mattern, Erlangen (DE); Peter Röhrer, Bubenreuth (DE); Peter Schardt, Höchstadt A.D. Aisch (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/520,065

(22) Filed: Sep. 12, 2006

(65) Prior Publication Data

US 2007/0064872 A1 Mar. 22, 2007

(30) Foreign Application Priority Data

Sep. 12, 2005 (DE) ..... 10 2005 043 372

(51) Int. Cl.
*H01J 36/06* (2006.01)

(52) U.S. Cl. ..... 378/136; 378/144

(58) Field of Classification Search ..... 378/119, 378/120, 121, 122, 125, 129, 136, 143, 144, 378/127

See application file for complete search history.

(56) References Cited

U.S. PATENT DOCUMENTS 4,821,305 A 4/1989 Anderson
5,768,337 A * 6/1998 Anderson ..... 378/136
6,128,367 A * 10/2000 Foerst et al. ..... 378/137
6,430,260 B1 * 8/2002 Snyder ..... 378/130
6,556,651 B1 4/2003 Thomson et al.
2004/0022360 A1 * 2/2004 Price et al. ..... 378/121
2005/0058253 A1 * 3/2005 Inazuru et al. ..... 378/143
2006/0233307 A1 * 10/2006 Dinsmore ..... 378/136

FOREIGN PATENT DOCUMENTS

DE 87 13 0424 U1 3/1989
EP 0 147 009 12/1989

* cited by examiner

*Primary Examiner*—Hoon Song
(74) *Attorney, Agent, or Firm*—Schiff Hardin LLP

(57) ABSTRACT

An x-ray radiator has a vacuum housing that can rotate around an axis, a cathode that thermionically emits electrons upon irradiation thereof by a laser beam, an anode that emits x-rays upon being struck by the electrons, an insulator that is part of the vacuum housing and that separates the cathode from the anode, electrodes or terminals to apply a high voltage between the anode and the cathode to accelerate the emitted electrons toward the anode to form an electron beam, a drive arrangement for rotation of the vacuum housing around its axis, an arrangement for cooling components of the x-ray radiator, and an arrangement that directs and focuses the laser beam from a stationary source that is arranged outside of the vacuum housing onto a spatially stationary laser focal spot on the cathode.

23 Claims, 2 Drawing Sheets

FIG 1
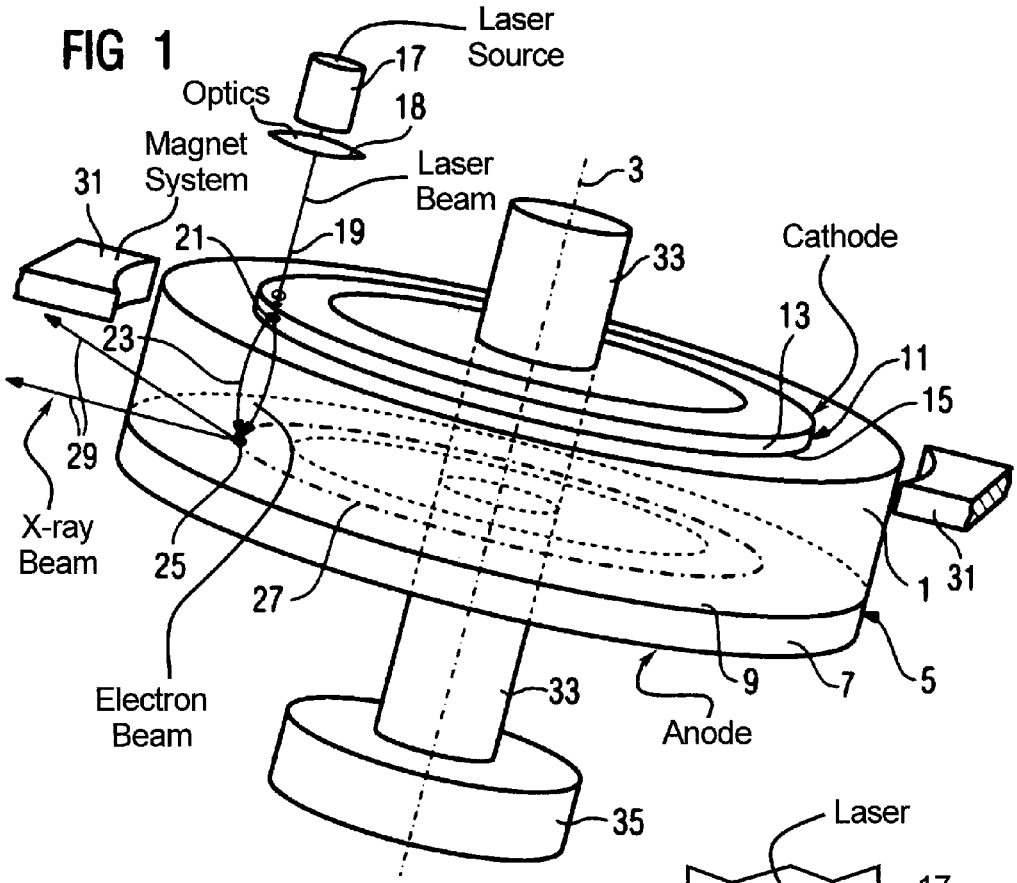
FIG 2
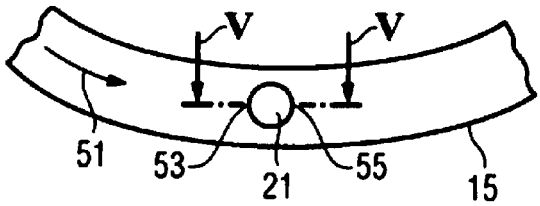
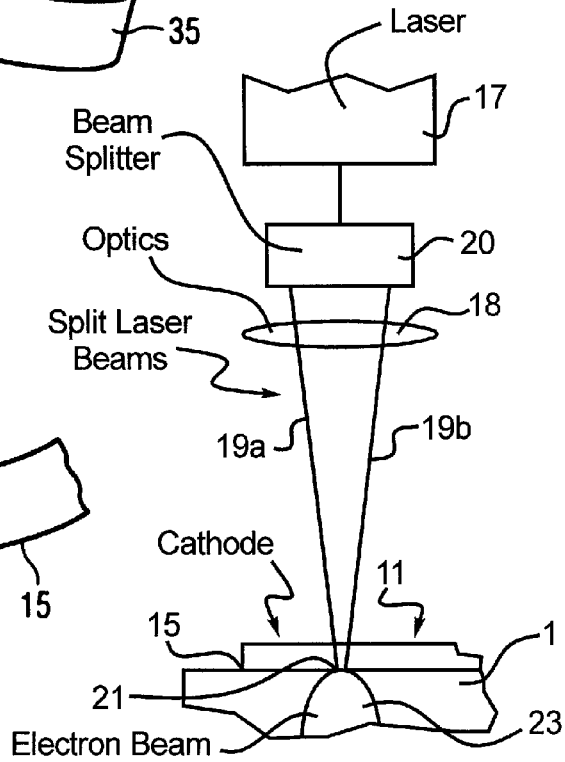
FIG 1A

X-RAY RADIATOR WITH THERMIONIC EMISSION OF ELECTRONS FROM A LASER-IRRADIATED CATHODE

BACKGROUND OF THE INVENTION

1. Field of the Invention

The present invention concerns an x-ray radiator with an evacuated housing supported for rotation around a rotation axle, in which housing are arranged a cathode and an anode, whereby the cathode having a surface that emits electrons upon laser irradiation, and having a drive arrangement to rotate the housing.

2. Description or the Prior Art

High-power x-ray radiators typically have an anode that is supported such that it can rotate in order to ensure a high thermal resilience of the anode even during generation of x-rays with high radiated power.

DE 87 13 042 U1 describes an x-ray tube with an evacuated housing supported such that it can rotate around a rotation axis, in which are arranged a cathode and an anode. The cathode and the anode are permanently connected with the housing. The x-ray tube has a drive arrangement to rotate the housing around the rotation axis. A deflection system that is stationary with regard to the housing, deflects an electron beam emanating from the cathode to the anode such that it strikes an annular impact surface on the anode, whereby the axis of the annular impact surface corresponds to the rotation aids that proceeds through the cathode. Since the anode is connected in a heat-conducting manner with the wall of the housing, a high heat dissipation from the anode to the outer surface of the housing is ensured. Effective cooling is possible with a coolant that is admitted to the housing.

In this known arrangement, a relatively long electron flight path exists due to the axis-proximal position of the cathode and the axle-remote position of the impact surface of the anode. This causes problems in the focusing of the electron beam. Among other things, this problem occurs in the generation of soft x-ray radiation for which a relatively low voltage is applied between the cathode and the anode. Due to the lower kinetic energy of the electrons, a higher defocusing of the electron beam occurs, dependent on the space charge limitation. The usage of such an x-ray tube therefore is possible only in a limited manner in specific applications such as, for example, in mammography.

U.S. Pat. No. 4,821,305 describes an x-ray tube in which both the anode and the cathode are arranged axially symmetrically in a vacuum housing that can be rotated as a whole around an axis. The cathode is rotatably supported and has an axially-symmetric surface made of a material that emits photoelectrons during the incidence of light. The electron emission is initiated by a stationary light beam that is focused from outside the vacuum housing through a transparent window onto the cathode.

The ability to convert this concept to a practical device appears questionable, however, due to the quantum efficiency of contemporary photo-cathodes and the luminous power required. With the use of high luminous power, the cooling of the photo-cathode requires a considerable effort due to its rather low heat resilience. The surface of the photo-cathode is additionally subject to oxidation processes in the vacuum conditions realized in x-ray tubes, which limits the durability of such an x-ray tube.

U.S. Pat. No. 5,768,337 discloses an x-ray tube wherein, in a vacuum housing in which the photo-cathode and the anode are arranged, a photomultiplier is interposed between the photo-cathode and the anode. A lower optical power is thereby necessary for generation of x-ray radiation. The longer electron flight path with multiple deflections of the electron beam between the dynodes, requires a high expenditure for focusing the beam.

An x-ray scanner, in particular a computed tomography apparatus, is known from EP 0 147 009 B1. X-rays are generated by an electron beam striking an anode. Among other things, the possibility is mentioned to generate the electron beam by thermionically-emitted electrons by a cathode surface being heated by a light ray. The surface of the cathode should be capable of being rapidly heated and cooled by the disclosed embodiment of the cathode with a support layer made of a material with high heat conductivity. This appears to be problematic, however, with regard to the luminous power then required.

U.S. Pat. No. 6,557,851 describes a system for generation of therapeutic x-rays. Among other things, the possibility is generally mentioned that the electron beam necessary for the generation of x-ray radiation is emitted from a thermionic cathode heated by a laser.

SUMMARY OF THE INVENTION

An object of the present invention is to provide an x-ray radiator of the aforementioned type as is used, for example, in medical radiology, in which a sufficient x-ray power can be generated with relatively low laser power; in which a simple focusing capability of the electron beam is possible; and in which a simple and efficient cooling of the system provides good reemployment capability.

This object is inventively achieved by an x-ray radiator having a vacuum housing that can rotate around an axis, a cathode that thermionically emits electrons upon irradiation thereof by a laser beam, an anode that emits x-rays upon being struck by the electrons, an insulator that is part of the vacuum housing and that separates the cathode from the anode, electrodes or terminals to apply a high voltage between the anode and the cathode to accelerate the emitted electrons toward the anode to form an electron beam, a drive arrangement for rotation of the vacuum housing around its axis, an arrangement for cooling components of the x-ray radiator, and an arrangement that directs and focuses the laser beam from a stationary source that is arranged outside of the vacuum housing onto a spatially stationary laser focal spot on the cathode.

This x-ray radiator achieves a sufficiently high electron current density with laser powers as are generated by diodes or solid-state lasers. Because the laser focal spot is also positioned remote from the rotation axis, a shortened beam path of the electron beam between laser focal spot and the anode focal spot can easily be realized so that a focusing and/or a deflection of the electron beam onto an anode focal spot can be achieved with simple means.

In a simple embodiment of the x-ray radiator the anode and/or the cathode are axially symmetric. In a simple manner this causes the electron beam or the laser beam to always strike the surface of the anode or the cathode during the rotation of the x-ray radiator.

In a further embodiment of the x-ray radiator, the anode and/or the cathode exhibits a discrete axial symmetry in the sense that a rotation of the anode or of the cathode around the axis by an angle that is a whole-number divisor of 360° leads to an identical view of the anode or of the cathode. This arrangement ensures that, given the (rapid) rotation of the x-ray radiator, no out-of-balance occurs due to the anode or the cathode. Nevertheless, the support layers of the anode or of the cathode can be configured differently in segments. For example, materials of high mechanical resistance (stability)

that are arranged as spokes in the cathode or in the anode can support segments of materials with high emission efficiency. Such an arrangement can be produced in a simple manner.

Preferably, the laser beam is asymmetrically deformed. An asymmetrical laser focal spot is thereby generated. Since the cathode surface rotates, movement of already-heated parts of the cathode surface ensues within the laser focal spot. At the edge at which the not-yet-heated cathode surface enters into the laser focal spot, higher laser powers are therefore necessary in order to achieve a specific temperature, than are necessary at the edge at which the already-heated cathode surface exits from the laser focal spot. An asymmetric laser focal spot with different laser power within the laser focal spot is generated by an asymmetrically-deformed laser beam. By the deformation, laser power can be spared and approximately equally steep rising and falling temperature gradients can be generated at the entrance and exit points of the cathode in the laser focal spot, which leads to an efficient electron emission at a constant level across the laser focal spot.

In a further embodiment, the laser beam can be split by an optical arrangement into at least two sub-rays that each form a partial laser focal spot. Due to the composition of the laser focal spot composed of partial focal spots, an asymmetrical laser focal spot can be produced in a simple manner. It has additionally been shown that the temperature of the cathode surface can be better controlled by a composite laser focal spot with regard to heating and cooling.

A laser diode or a solid-state laser can be used as the laser.

In a preferred embodiment the laser beam is variable in terms of its shape. The cross-section of the electron beam can be varied in shape by variation of the laser focal spot size. The intensity of the laser beam can also be varied appropriately. The electron current strength thus can be varied by the injected (coupled) laser power. In an embodiment, the time structure of the laser beam is likewise variable. The heating and the cooling of the laser focal spot can be regulated in an additional, simple manner by this embodiment, by using (for example) a pulse laser beam. The components required for the control and shaping of the laser beam can be accommodated within or outside of the vacuum housing.

In a further embodiment, the surface of the cathode can be pre-heated electrically, optically and/or inductively. Pre-heating of the cathode allows use of a lower laser power in order to generate via the laser, the temperature necessary for the thermionic electron emission. The pre-heating allows the temperature of the cathode to be approximated to the emission temperature for the electron emission. Overall, a lower laser power is thus required in order to effect an electron emission. The closer that the temperature during the preheating is brought to the temperature that must be reached for a thermionic electron emission, the smeller the laser power that is necessary for the electron emission.

In a preferred embodiment, the surface of the cathode is applied on a support layer. Due to special properties of the support layer with regard to heat conductivity, heat capacity and density, the dissipation of the heat from the surface of the cathode and the conservation of the base temperature of the surface can be optimized, such that the laser power for generation of the temperature for the thermionic emission of electrons in the laser focal spot can be reduced or even minimized.

In another embodiment of the invention, the support layer of the cathode exhibits a lower heat conductivity than the surface of the cathode. An overly rapid cooling of the cathode is thereby prevented.

In a further embodiment, the support layer exhibits a lower heat capacity and/or a lower density than the surface of the cathode. This also allows the temperature of the cathode to be kept near the threshold for electron emission. The cathode thereby remains flexible and can quickly react to changes of the laser intensity and laser focal spot geometry.

In another embodiment of the invention, the electron beam in the region between cathode and anode can be shaped and deflected by a magnet system that generates a magnetic field in the region of the electron beam.

According to a further embodiment, the electron beam can be shaped by electrostatic system between the cathode and the anode.

In a particularly simple form of the x-ray radiator, the vacuum housing is fashioned cylindrically and supported symmetrically around the cylinder axis. In this special form of the vacuum housing, the cathode is fashioned as the base of the cylinder and the anode is fashioned as an oppositely-situated base.

In a material-saving embodiment, the cathode is designed as a circular ring. The anode is likewise fashioned as a circular ring in a material-saving design. With such an execution the cathode or the anode also can be designed particularly stable since the ring (made from the specific anode material or cathode material) can be embedded into a particularly stable material.

In a further embodiment, the x-ray radiator is fashioned such that the laser beam passes through the support layer to strike the surface of the cathode. In this embodiment the cathode can be fashioned as an outer surface of the vacuum housing.

In another embodiment, the vacuum housing has a window that is optically transparent for the laser, through which window the laser strikes the surface of the cathode.

The x-ray radiator is preferably supported in a radiator housing such that it can rotate, the radiator housing being filled with a coolant. An effective cooling of the entire system is thereby ensured.

The vacuum housing can include heat conducting components that transport heat from the components of the vacuum housing to the outer surface of the vacuum housing. A high heat dissipation of heated elements that are located, for example, inside the vacuum housing (such as the anode surface) is thereby ensured.

DESCRIPTION OF THE DRAWINGS

FIG. 1 schematically illustrates a vacuum housing of an x-ray radiator in accordance with the invention.

FIG. 1A schematically illustrates a portion of the x-ray radiator of FIG. 1 in an embodiment employing split laser beams.

FIG. 2 is a section of a cathode ring at the point of a laser focal spot in accordance with the invention.

DESCRIPTION OF THE PREFERRED EMBODIMENTS

Figure 3:
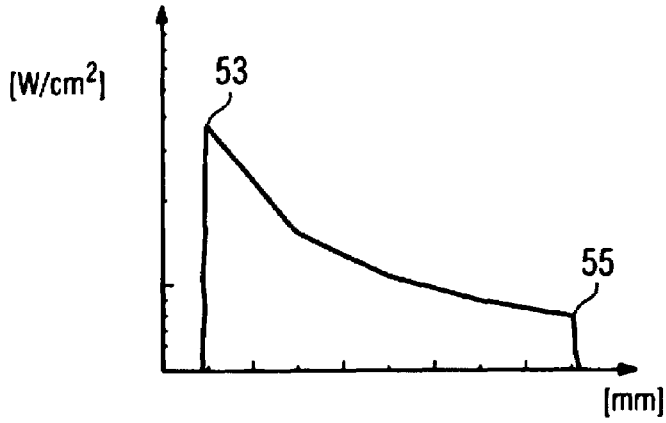
FIG. 3 schematically shows a profile of the laser power in the laser focal spot along the line V-V in FIG. 2 in a coordinate system with the laser power as a y-axis and the position in the laser focal spot on the x-axis.

A three-dimensional representation of a vacuum housing 1 is shown in FIG. 1. The vacuum housing 1 is fashioned as a cylinder in which the cylinder casing is formed by an insulating material, and the vacuum housing 1 is supported rotationally symmetrically around an axle 3. An anode 5 forms the base of the cylinder. The anode has a support layer 7 and an annularly-fashioned surface 9 from which x-rays 29 are emitted. Located in the oppositely-situated base of the vacuum housing 1 (cylinder) is an annularly-fashioned cathode 11. It has a support layer 13 that is part of the outside of the vacuum housing 1 and a surface 15 faces the inside of the vacuum housing 1.

The anode 5 and cathode 11 shown here are fashioned axially symmetric. However, it can also be advantageous to fashion the anode 5 and the cathode 11 (in particular their support layers 7, 13) such that they exhibit only a discrete axial symmetry. The means a segment-by-segment design of the cathode 11 or of the anode 5, such that a rotation of the cathode 1 or of the anode 5 by a whole-number factor of 360° leads to an identical view of the cathode 11 or of the anode 5.

The surface 15 of the cathode 11 is formed of a material with a low vapor pressure and a high melting point such as, for example, tungsten (typically used in x-ray cathodes). The support layer 13 is optimized with regard to its heat capacity, its heat conductivity and its density such that the temperature of the surface 15 is kept near to the temperature required for the thermionic emission of electrons. A lower power of the laser beam 19 is thereby necessary. In one embodiment, the support layer 13 is made of the same material as the surface 15. The material is not used in pure form but rather in a sintered hollow sphere structure. The density, the heat capacity and the heat conductivity of the support layer 13 are thereby reduced in comparison to the surface 15. The temperature of the surface 15 can thereby be kept near to the emission temperature for electrons.

A laser beam 19 is directed from a spatially stationary laser source 17 onto the cathode 11. The laser source 17 is typically fashioned as a diode laser or solid-state laser. The laser beam 19 passes through the support layer 13 to strike in a laser focal spot 21 on the surface 15 of the cathode 11. The laser beam 19 is varied by optics 18 in terms of its shape, intensity and/or time structure. As shown in FIG. 1A, the laser beam can also be split by a beam splitter 20 into partial laser beams 19*a* and 19*b*. Each of the partial laser beams 19*a* and 19*b* in this case generates a partial laser focal spot, of which the laser focal spot 21 is composed.

When the laser focal spot passes through the support layer 13 from outside the vacuum housing 1 to strike the surface 15 of the cathode 11 as in this case, the optical arrangement 16 that varies the laser beam 19 in terms of its properties is located outside of the vacuum housing 1. If, as is shown later in FIG. 5, the laser beam is incident inside the vacuum housing 1 through an optically transparent window 63, the optic 18 can also be located inside the vacuum housing 1.

Electrons in the form of an electron cloud emanate from the laser focal spot 21 and are directed in an electron beam 23 onto the anode 5 via the high voltage applied between cathode 11 and anode 5. The electron beam 23 thereby strikes the surface 9 of the anode 5 in a spatially stationary focal spot 25. Due to the rotation of the vacuum housing 1, the resulting heat is distributed along the focal ring placed on the surface 9 of the anode 5. The heat is conducted to the outside of the vacuum housing 1 via the support layer 7 of the anode 5.

X-ray radiation 29 is emitted from the focal spot 26. The material at the point of the vacuum housing 1 from which the x-ray radiation emerges is transparent for x-ray radiation 29. A magnet system 31 is located outside of the vacuum housing 1 such that the electron beam 23 can be shaped and deflected. Alternatively, instead of the magnet system 31 an electrostatic arrangement (for example capacitors) can also be attached using which the electron beam can be shaped and deflected. A motor 35 that is connected with the vacuum housing 1 via a drive shaft 33 rotates the vacuum housing 1 around its axis 3. The longitudinal axis of the drive shaft 33 thereby coincides with the axis 3 of the vacuum housing 1. Terminals in order to apply a high voltage between the anode 5 and the cathode 11 are located in the drive shaft 33.

FIG. 2 shows an aspect of a section from the annularly-fashioned surface 15 of the cathode 11 with the laser focal spot 21. The rotation direction 51 of the cathode 11 is characterized by an arrow. The rotating surface 15 of the cathode 11 enters at the left edge 53 of the spatially-stationary loser focal spot 21. The surface 15 of the cathode 11 is cooled at this point. The rotating surface 15 of the cathode 11 is heated within the laser focal spot. The heated surface 15 of the cathode 11 exits the laser focal spot 21 again at the right edge 55.

FIG. 3 shows the profile of the laser power of the asymmetrically-deformed laser focal spot 21 along the line V-V. The x-axis shows the position in the laser focal spot 21 along the line V-V in millimeters, the y-axis shows the laser power in $W/cm^2$. The laser power is clearly higher at the left edge 53 and decreases in a curve; the laser power is minimal at the right edge 55. The laser power decreasing in the laser focal spot 21 allows for the fact that the cooled surface 15 of the cathode 11 enters into the laser focal spot 21 at the left edge 53. Higher laser powers are thus necessary in order to reach a desired temperature then are necessary at the right edge 55, where the surface 15 of the cathode 11 already heated exits again from the laser focal spot 21.

The asymmetric laser power in the laser focal spot 21 is thereby generated by the optical arrangement 18 that shapes the laser beam 19 from a laser source 17 such that the laser power is asymmetric in cross-section. Overall laser power is saved with this method since the laser power in the laser focal spot is adapted to the power necessary to achieve the necessary emission temperature.

Figure 4:
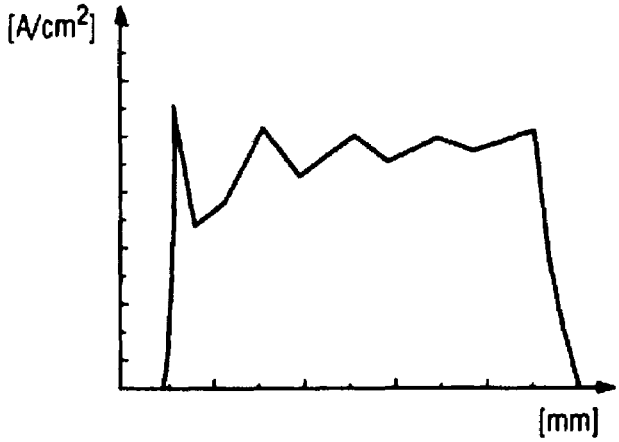
FIG. 4 shows the electron emission resulting from the laser radiation in a coordinate system with the electron current density on the y-axis and the position in the laser focal spot on the x-axis.

FIG. 4 shows the electron emission in asymmetrically deformed laser focal spot 21 along the line V-V as it results from a model simulation. The x-axis shows the position in the laser focal spot 21 along the line V-V in millimeters, the y-axis shows the electron emission in A/cm. Despite of some fluctuations in the emission profile, a largely constant electron emission appears over the entire laser focal spot 21, which electron emission drops significantly outside of the laser focal spot 21.

Figure 5:
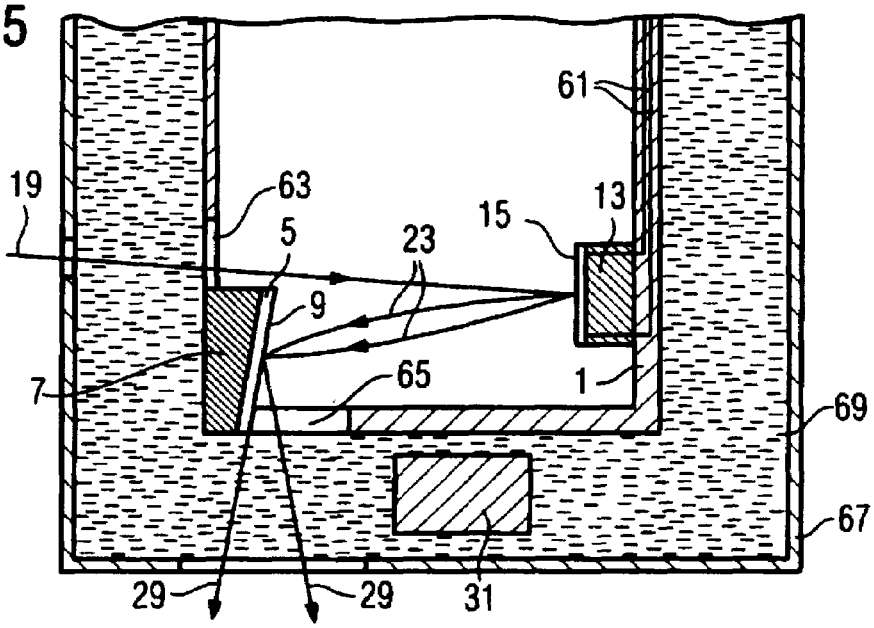
FIG. 5 is a partial longitudinal section through a part of a further embodiment of the vacuum housing.

FIG. 5 shows a longitudinal section of a further cylindrical design of the vacuum housing 1. The cathode 11 comprises a surface 15 and a support layer 13 and is entirely located inside the vacuum housing 1. The laser beam 19 passes through an optically-transparent window 62 that is located in the opposite base of the vacuum casing 1 to strike the surface 15 of the cathode 11. So that the optical window does not significantly lose its transparency in the course of the usage of the x-ray radiator, it can be protected by protective plates from fogging with material that vaporizes during the operation of the x-ray radiator.

The surface 15 of the cathode 11 can be heated by an electrical arrangement 61. The base temperature of the surface 15 of the cathode 11 increases such that less laser power is required in order to achieve the corresponding emission temperature. The surface 15 can also be optically pre-heated (for example by a further laser beam) or inductively preheated (by further magnetic fields). The laser beam 19 can also be used for an optical pre-heating of the cathode 11 in that it is operated below the power that is required for the electron emission.

The electron beam 23 strikes the surface 9 of the anode 5 that is located on a support layer 7 that transports the heat from the surface of the anode 9 to the outside of the vacuum housing. X-rays pass from the surface of the anode 9 through a region 65 of the vacuum housing that is transparent for x-rays. The entire vacuum housing 1 is surrounded by a radiator housing 67 that is filled with a coolant 69, such that an effective cooling of the entire system is ensured.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray radiator comprising:

an evacuated housing mounted for rotation around an axis;

a cathode disposed in said housing;

a laser source that emits a laser beam from a stationary location outside of said vacuum housing onto a spatially stationary laser focal spot on said cathode, said laser source emitting said laser beam with a laser power that heats said cathode to cause said cathode to thermionically emit electrons;

an anode disposed in said housing on which said electrons are incident that emits x-rays upon being struck by said electrons;

an insulator forming a part of said vacuum housing that separates said cathode from said anode;

terminals for application of voltage between said anode and said cathode to accelerate said electrons from said cathode toward said anode as an electron beam;

a drive in driving engagement with said housing to rotate said housing around said axis; and a cooling arrangement in thermal communication with at least one of said anode, said cathode and said housing to conduct heat therefrom.

2. An x-ray radiator as claimed in claim 1 wherein at least one of said anode and said cathode is axially symmetric.

3. An x-ray radiator as claimed in claim 1 wherein said anode exhibits a discrete axial symmetry such that rotation of said anode around said axis by an angle that is a whole-number divisor of 360° results in an identical view of the anode.

4. An x-ray radiator as claimed in claim 1 wherein said cathode exhibits a discrete axial symmetry such that rotation of said cathode around said axis by an angle that is a whole-number divisor of 360° results in an identical view of the cathode.

5. An x-ray radiator as claimed in claim 1 wherein said laser source generates an asymmetrically deformed laser beam that produces, as said laser focal spot on said cathode, an asymmetrical laser focal spot on said cathode.

6. An x-ray radiator as claimed in claim 1 wherein said laser source includes an optical splitter that splits said laser beam into at least two sub-beams, said at least two sub-beams forming respective portions of said laser focal spot on said cathode.

7. An x-ray radiator as claimed in claim 1 wherein said laser source comprises a laser beam emitter selected from the group consisting of a laser diode and a solid-state laser.

8. An x-ray radiator as claimed in claim 1 wherein said laser source comprises at least one component that varies a characteristic of said laser beam selected from the group consisting of beam shape, beam intensity, and a time structure of said beam.

9. An x-ray radiator as claimed in claim 1 comprising a heating arrangement that preheats a surface of said cathode, on which said laser focal spot is incident, to allow a reduced-power laser beam to cause thermionic emission of said electrons at said surface of said cathode, said heating arrangement being selected from the group consisting of electrical heating arrangements, optical heating arrangements, and inductive heating arrangements.

10. An x-ray radiator as claimed in claim 1 wherein said cathode comprises a support layer, and a surface attached to said support layer on which said laser focal spot is incident.

11. An x-ray radiator as claimed in claim 10 wherein said support layer has a lower heat conductivity than said surface.

12. An x-ray radiator as claimed in claim 10 wherein said support layer has lower heat capacity than said surface.

13. An x-ray radiator as claimed in claim 10 wherein said support layer has a lower density than said surface.

14. An x-ray radiator as claimed in claim 1 comprising a magnet system that generates a magnetic field between said cathode and said anode, that interacts with said electron beam to shape and deflect said electron beam.

15. An x-ray radiator as claimed in claim 1 comprising an electrode system that generates an electrostatic field between said cathode and said anode, that interacts with said electron beam to shape and deflect said electron beam.

16. An x-ray radiator as claimed in claim 1 wherein said housing is a cylinder that is symmetrically supported around said axis.

17. An x-ray radiator as claimed in claim 16 wherein said cathode forms a first base of said cylinder and said anode is disposed at a second, opposite base of said cylinder.

18. An x-ray radiator as claimed in claim 1 wherein said cathode is a circular ring.

19. An x-ray radiator as claimed in claim 1 wherein said anode is a circular ring.

20. An x-ray radiator as claimed in claim 1 wherein said cathode has a cathode surface on which said laser focal spot is incident, and a support layer to which said cathode surface is attached, and wherein said laser beam source is situated relative to said cathode so that said laser beam passes through said support layer of said cathode to strike said surface.

21. An x-ray radiator as claimed in claim 1 wherein said housing has an optically transparent window through which said laser beam passes to reach said cathode.

22. An x-ray radiator as claimed in claim 1 comprising a radiator housing in which said evacuated housing is rotatably mounted, and wherein said cooling arrangement includes coolant circulating in said radiator housing.

23. An x-ray radiator as claimed in claim 1 wherein said housing comprises heat conducting components that transport heat from at least one of said cathode and said anode inside said housing to an exterior surface of said housing.

* * * * *